United States Patent [19]

Morgan

[11] 4,376,313

[45] Mar. 15, 1983

[54] ACCESS PORT FOR A COMMODE

[76] Inventor: Charles J. Morgan, 917 S. Charles St., Baltimore, Md. 21230

[21] Appl. No.: 239,328

[22] Filed: Mar. 2, 1981

[51] Int. Cl.[3] ..... E03D 11/00

[52] U.S. Cl. ..... 4/255

[58] Field of Search ..... 4/255–257

[56] References Cited

U.S. PATENT DOCUMENTS

| | | | |
|---|---|---|---|
| 918,036 | 4/1909 | Gibson | 4/257 |
| 1,275,768 | 8/1918 | Schuh | 4/257 |
| 1,827,663 | 10/1931 | Mastrillo | 4/257 |
| 2,540,812 | 2/1951 | Marzo | 4/257 |
| 3,654,641 | 4/1972 | Braun, Sr. | 4/257 |
| 3,681,791 | 8/1972 | Gray | 4/257 |

FOREIGN PATENT DOCUMENTS

| | | | |
|---|---|---|---|
| 152339 | 8/1921 | United Kingdom | 4/257 |

*Primary Examiner*—Henry K. Artis

*Attorney, Agent, or Firm*—Walter G. Finch

[57] ABSTRACT

The invention is an improvement in the structure of commodes or toilets to facilitate maintenance when the commode or toilet bowl becomes clogged with an obstruction of some type. The invention provides an easily accessible, removable, sealable, and replaceable access port at, near, or in the vicinity of the trap portion of the commode or toilet where the obstructions usually lodge, and where they are inaccessible without disconnecting and removing the commode or toilet from its sealed setting. The access port may be part of the commode or toilet bowl structure on commodes or toilet bowls with a front or rear trap. The invention eliminates the disconnecting and removal of the commode or toilet bowl and the subsequent resealing, resetting and reconnecting of the commode or toilet bowl.

10 Claims, 6 Drawing Figures

ACCESS PORT FOR A COMMODE

BACKGROUND AND SUMMARY OF THE INVENTION

The invention relates to plumbing fixtures and in particular to commodes or toilet bowls. Specifically, the invention relates to access means to the trap portions of commodes or toilet bowl structures for the purpose of clearing obstructions in the trap or the vicinity of the trap.

A need has existed for a convenient means for clearing obstructions which clog commodes or toilet bowls from time to time. These obstructions usually occur in the trap portion of the commode or toilet bowl, or in the vicinity of the trap and cannot be reached from the hopper area of the commode or toilet bowl.

The obstructions may be of a wide variety, such as, but not limited to, children's small toys, balls, bottles, small brushes, and other articles. Once these articles pass out of the commode or toilet bowl hopper and into the trap portion they cannot be reached or retrieved from the hopper area. Sewage debris then collects on and around the obstruction and the sewer system is effectively clogged.

In the prior art the procedure requires disconnecting the commode or toilet bowl, breaking the seal, removing the obstruction. Then it is necessary to replace the seal with a new seal where the facility connects to the sewer system, reset the commode or toilet bowl, and reconnect the commode or toilet bowl. Thus, the prior art is a time consuming, difficult, and expensive procedure. The present invention eliminates these problems.

The present invention provides an easily accessible, sealable, and replaceable access port at, near, or in the vicinity of the trap portion of the commode or toilet bowl. The access port is located at substantially the normally inaccessible point where the obstructions lodge in the trap area and cause the clogging. Thus, the present invention provides a quick, easy, inexpensive means of gaining access to the point of the problem so that the obstruction can be removed. Closing the sealable access port is a very simple process and the maintenance work is completed.

The present invention may be incorporated in the structure of commodes or toilet bowls having a trap at either the front or the back of the hopper of the commode or toilet bowl.

It is, therefore, an object of the invention to provide an access means in a commode or toilet bowl type facility to remove obstructions within the facility.

It is another object of the invention to provide an access means in a commode or toilet bowl type facility having a trap at either the front or the back of the facility.

It is also an object of the invention to provide an access means in a commode or toilet bowl type facility that is sealable when closed.

It is still another object of the invention to provide an access means in a commode or toilet bowl type facility that does not require disconnecting the facility.

It is yet another object of the invention to provide an access means in a commode or toilet bowl type facility that does not require replacing the main seal of the facility to the sewer connection.

It is yet another object of the invention to provide an access means in a commode or toilet bowl type facility that is easy to open to remove an obstruction and easy to close.

Further objects and advantages of the invention will become more apparent in the light of the following description of the preferred embodiments.

DESCRIPTION OF THE PREFERRED EMBODIMENTS

Figure 1:
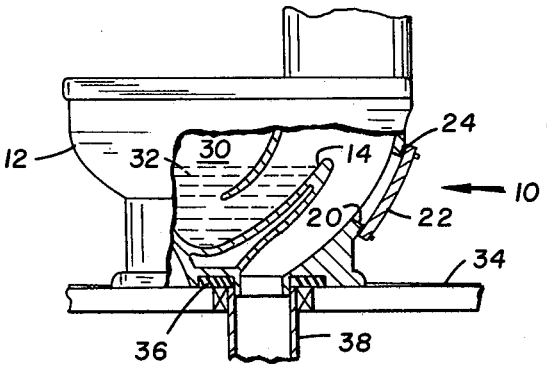
FIG. 1 is a cross sectional view of a typical toilet bowl having a trap in the rear portion of the structure, and an access port to clear obstructions in the vicinity of the trap.
Figure 2:
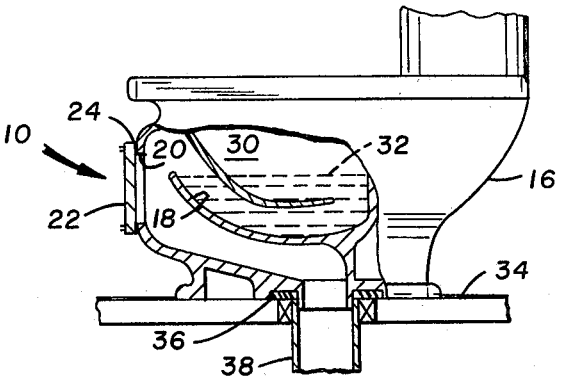
FIG. 2 is a cross sectional view of a typical toilet bowl having a trap in the front portion of the structure, and an access port to clear obstructions in the vicinity of the trap.
Figure 3:
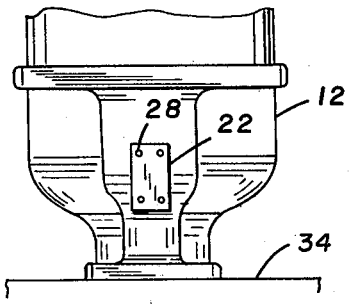
FIG. 3 is a rear view of a typical toilet bowl of FIG. 1 showing a covered access port.
Figure 4:
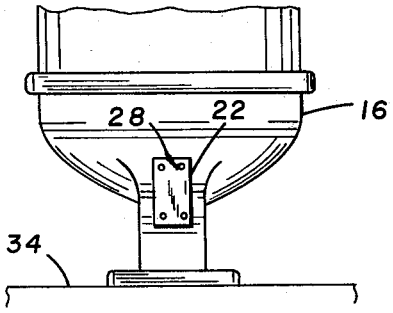
FIG. 4 is a front view of a typical toilet bowl of FIG. 2 showing a covered access port.

Referring to the drawings and particularly to FIGS. 1 and 2, an access port on a typical toilet bowl or commode is shown at 10. FIG. 1 shows an access port 10 on the rear end of a typical toilet bowl or commode 12 having a trap 14 in the back portion of the toilet bowl 12. FIG. 2 shows an access port 10 on the front end of a typical toilet bowl or commode 16 having a trap 18 in the front portion of the toilet bowl 16.

It is to be noted that the toilet bowls or commodes 12 and 16 illustrated in the drawings are typical structures. There are numerous toilet bowl and commode structures made with special features and configurations by various manufacturers, the basic structure, however, follows the typical structures shown in the drawings. Whatever the shape, size, configuration, or design, the access port 10 of this invention is applicable to all of the structures, the only modification being to shape the cover, as described hereinafter, to fit and match the configuration of the toilet bowl or commode to which it is applied.

Figure 5:
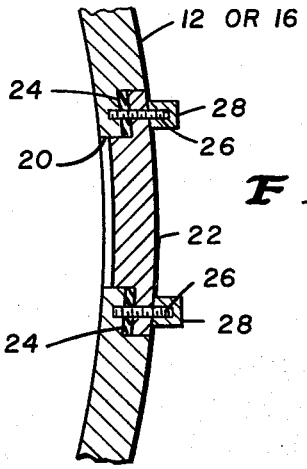
FIG. 5 is an enlarged partial cross section through a typical toilet bowl and a covered access port.

The access port 10 consists of an aperture 20 in the structure of the typical toilet bowls 12 or 16, a cover means 22 for the aperture 20, a seal means 24, and a suitable fastening means 26 as shown in FIG. 5. The aperture 20 communicates between the interior of the typical toile bowls 12 or 16 and the exterior thereof.

It is to be noted that the fastening means 26 may be a plurality of studs projecting from the toilet bowl or commode structures 12 or 16 which fit matching or mating apertures 44 in the cover means 22. Suitable nut-like means 28 on each of the fastening means 26, a plurality of studs as noted hereinbefore, hold the cover means 22 tightly against the seal means 24 and effectively closes and seals the aperture 20.

It is to be understood that other suitable fastening means may be used to clamp the cover means 22 tightly against the seal means 24, and such other suitable fastening means is within the scope and intent of this invention.

The nut-like means 28 may be of various types such as, but not limited to, porcelain or ceramic covered nut-like means to provide a matching appearance as well as a smooth surface. A crown-type nut-like means 28 is shown in FIG. 5, however, it is to be understood that any other configuration is within the scope and intent of this invention, including decorative covers for the nut-like means 28.

The seal means 24 may be cork, rubber-like material of any other flexible and compressible material which will effectively seal around the periphery of the cover means 22 to the surface of the typical toilet bowl 12 or 16 and close the aperture 20 tightly.

Figure 6:
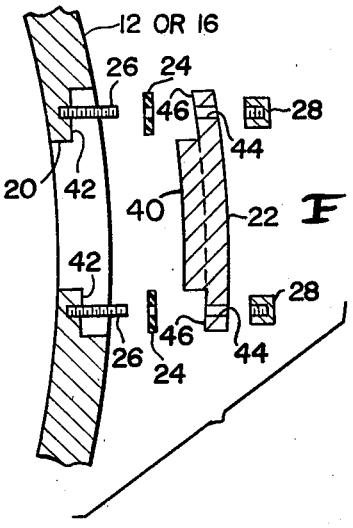
FIG. 6 is an exploded view of FIG. 5.

The cover means 22 may be a ceramic, plastics, metal, porcelain covered material, or any other suitable material. Normally the cover means 22 may be of the same material as the toilet bowl 12 or 16 structure, but may be of any other suitable material and such variation is within the scope and intent of this invention. In FIGS. 5 and 6 it is to be noted that the configuration of the cover means 22 is shown with a projection or raised portion 40 thereon fitting into the aperture 20 as well as surrounding the aperture 20 on the exterior thereof in order to fit over and compress the seal means 24. It is also to be noted that the cover means 22 may be set into a depression or recessed shoulder 42 so that the exterior surface of the cover means 22 is flush with the surrounding area of the toilet bowl.

It is to be understood, however, that a cover means 22 without a projection or raised portion 40 thereon to fit into the aperture 20, or with the flange portion on the exterior of the bowl surface, are also within the scope and intent of this invention.

Thus, when an obstruction has passed out of the hopper area 30 of the typical toilet bowls 12 or 16 and lodged somewhere in the trap 14 or 18 areas, the facility is available for a quick, easy and readily accessible means to clear the clogged system. By removing the nut-like means 28 and lifting the cover means 22 from the fastening means 26, the aperture 20 provides a ready access to reach into the trap 14 or 18 area and clear the obstruction.

Replacing the cover means 22 and again compressing the seal means 24 as the nut-like means 38 are tightened on the fastening means 26 effectively seals the aperture 20 and completes the maintenance job of clearing the obstruction and putting the facility back in service.

It is to be noted that the cover means 22 is shaped and configured to match the exterior shape and configuration of the toilet bowl or commode 12 or 16 to which it is applied.

In FIGS. 1 and 2 the water level 32 can be seen in the hopper area 30 and in the traps 14 and 18 of toilet bowl structure 12 and 16 respectively. When the access port 10 must be opened to remove an obstruction from the trap area 14 or 18, or from the area beyond the traps 14 or 18, the water in the hopper area 30 and the traps 14 or 18 are not spilled on the floor 34.

The use of the access port 10 of this invention eliminates disconnecting the toilet bowls 12 or 16, and breaking the main toilet seal 36 at the sewer system connection 38, and then the replacement of the main seal 36, resetting the toilet bowls 12 or 16 and reconnecting the fixture.

The water tank for the toilet bowls 12 or 16 and the toilet seats are not shown in the drawings as these are not a part of the present invention.

As can be readily understood from the foregoing description of the invention, the present structure can be configured in different modes to provide the ability to provide access to areas of a toilet bowl or commode to clear an obstruction which is not available in the prior art.

Accordingly, modifications, and variations to which the invention is susceptible may be practiced without departing from the scope and intent of the appended claims.

What is claimed is:

1. An access means for clearing obstructions from inaccessible areas of a passageway through a structure, comprising:

a partially enclosed structure, said structure having enclosing walls and a passageway therethrough, said passageway having enclosing walls, a portion of said passageway enclosing walls being in common with said enclosing walls of said partially enclosed structure, said passageway having inaccessible areas to the exterior of said passageway and said enclosure structure;

an aperture, said aperture being located in said portion of said passageway enclosing walls in common with said enclosing walls of said partially enclosed structure, said aperture communicating with the interior of said passageway in the vicinity of said inaccessible areas and the exterior of said passageway and concurrently the exterior of said partially enclosed structure, said aperture having a recessed shoulder therearound at the exterior surface of said passageway enclosing walls;

a cover means, said cover means being configured to removably fit over and close said aperture, said cover means fitting into said recessed shoulder around said aperture, said cover means having a raised portion thereon, said raised portion being on the inward surface of said cover means, said raised portion being configured to fit into said aperture leading into said passageway;

a seal means, said seal means being removably located in said recessed shoulder around said aperture, said seal means thereby being between said cover means and said recessed shoulder, said seal means being positioned and extending around the periphery of said aperture;

a fastening means, said fastening means affixing said cover means to said partially enclosed structure, said fastening means thereby clamping said seal means between said cover means and said recessed shoulder and concurrently effectively closing and sealing said aperture.

2. An access means as recited in claim 1, wherein said partially enclosed structure is a toilet.

3. An access means as recited in claim 1, wherein said seal means is flexible and rubber-like.

4. An access means as recited in claim 1, wherein said fastening means is a plurality of studs, said studs being spaced apart around the periphery of said aperture and suitably affixed to said recessed shoulder around said aperture in said passageway enclosing walls of said partially enclosed structure, said studs having suitable removably affixed nut-like means therewith.

5. An access means as recited in claim 4, wherein said cover means has a plurality of spaced apart apertures therein around the periphery thereof, said plurality of spaced apart apertures matching the pattern of said spaced apart studs, said apertures thereby mating with said plurality of studs.

6. An access means as recited in claim 2, wherein said toilet is a type having a rearward trap means.

7. An access means as recited in claim 2, wherein said toilet is a type having a forward trap means.

8. An access means as recited in claim 6, wherein said aperture in said passageway enclosing walls is downstream from said rearward trap means and adjacent to said inaccessible areas.

9. An access means as recited in claim 7, wherein said aperture in said passageway enclosing walls in downstream from said forward trap means and adjacent to said inaccessible areas.

10. An access means as recited in claim 2, wherein said inaccessible areas are inaccessible when said toilet is installed and connected to a sewer system.

* * * * *